US009298167B2

(12) United States Patent
Braunberger

(10) Patent No.: US 9,298,167 B2
(45) Date of Patent: Mar. 29, 2016

(54) TIMING SYSTEM AND DEVICE AND METHOD FOR MAKING THE SAME

(71) Applicant: Vision Works IP Corporation, Sequim, WA (US)

(72) Inventor: Alfred S. Braunberger, Sequim, WA (US)

(73) Assignee: Vision Works IP Corporation, Sequim, WA (US)

( * ) Notice: Subject to any disclaimer, the term of this patent is extended or adjusted under 35 U.S.C. 154(b) by 377 days.

(21) Appl. No.: 13/717,303

(22) Filed: Dec. 17, 2012

(65) Prior Publication Data

US 2013/0163392 A1 Jun. 27, 2013

Related U.S. Application Data

(60) Provisional application No. 61/580,132, filed on Dec. 23, 2011.

(51) Int. Cl.

| | |
|---|---|
| ***G04F 1/00*** | (2006.01) |
| ***G04F 13/04*** | (2006.01) |
| ***G04F 1/02*** | (2006.01) |

(52) U.S. Cl.

CPC *G04F 13/04* (2013.01); *G04F 1/00* (2013.01); *G04F 1/02* (2013.01)

(58) Field of Classification Search

CPC ..... G04F 1/00; G04F 1/005; G04F 10/10; G04F 13/04; G04F 1/02; G01K 3/04

USPC ..... 368/114, 327

See application file for complete search history.

(56) References Cited

U.S. PATENT DOCUMENTS

| | | | | |
|---|---|---|---|---|
| 2,651,755 | A | | 9/1953 | Triplett |
| 3,119,754 | A | * | 1/1964 | Blumenfeld et al. ..... 368/114 |
| 3,210,662 | A | * | 10/1965 | Steinmetz et al. ..... 324/94 |
| 3,336,212 | A | * | 8/1967 | Nicholas et al. ..... 374/102 |
| 3,512,049 | A | * | 5/1970 | Hoberman et al. ..... 361/501 |
| 3,543,582 | A | * | 12/1970 | Sessler ..... 374/103 |
| 3,564,347 | A | | 2/1971 | Peck |
| 3,613,002 | A | | 10/1971 | Trenkler et al. |
| 3,638,120 | A | | 1/1972 | Jost |
| 3,768,015 | A | * | 10/1973 | Moser ..... 368/114 |
| 3,942,467 | A | | 3/1976 | Witonsky |
| 3,974,495 | A | * | 8/1976 | Jones ..... 340/309.16 |
| 3,999,946 | A | | 12/1976 | Patel et al. |
| 4,084,511 | A | * | 4/1978 | Svrjcek, Jr. ..... 102/277 |
| 4,100,490 | A | * | 7/1978 | Peck et al. ..... 368/114 |
| 4,153,345 | A | | 5/1979 | Duchene et al. |
| 4,212,153 | A | | 7/1980 | Kydonieus et al. |

(Continued)

FOREIGN PATENT DOCUMENTS

| | | |
|---|---|---|
| WO | 0182006 A1 | 11/2001 |
| WO | 03/052524 | 6/2003 |

(Continued)

*Primary Examiner* — Vit W Miska

(74) *Attorney, Agent, or Firm* — Haverstock & Owens LLP

(57) ABSTRACT

A timing device comprises an electrochemical timing structure and a mechanism that enables the timing device to be manually programmed to expire at a plurality of different time periods. In some embodiments, the mechanism is used to adjust the timing device to add a duration of time to an expiration time of the timing device. Alternatively the mechanism is used in order to subtract a duration of time from an expiration time of the timing device.

23 Claims, 4 Drawing Sheets

(56) References Cited

U.S. PATENT DOCUMENTS

| | | | | |
|---|---|---|---|---|
| 4,277,974 | A | | 7/1981 | Karr et al. |
| 4,308,486 | A | | 12/1981 | Gange |
| 4,327,117 | A | | 4/1982 | Lenack et al. |
| 4,392,236 | A | | 7/1983 | Sandstrom et al. |
| 4,488,780 | A | | 12/1984 | Nicholson |
| 4,505,595 | A | | 3/1985 | Rose et al. |
| 4,527,522 | A | | 7/1985 | Cerny |
| 4,629,330 | A | | 12/1986 | Nichols |
| 4,797,864 | A | | 1/1989 | Stano et al. |
| 4,804,275 | A | | 2/1989 | Kang et al. |
| 4,844,622 | A | | 7/1989 | Weiss |
| 4,860,269 | A | | 8/1989 | Hennings et al. |
| 4,929,090 | A | | 5/1990 | Grahm |
| 5,034,233 | A | | 7/1991 | McCoy, Jr. |
| 5,045,283 | A | | 9/1991 | Patel |
| 5,053,339 | A | | 10/1991 | Patel |
| 5,085,802 | A | | 2/1992 | Jalinski |
| 5,182,212 | A | | 1/1993 | Jalinski |
| 5,254,473 | A | | 10/1993 | Patel |
| 5,339,024 | A | | 8/1994 | Kuo et al. |
| 5,368,905 | A | | 11/1994 | Ohno |
| 5,418,086 | A | | 5/1995 | Bailey |
| 5,420,000 | A | | 5/1995 | Patel et al. |
| 5,446,705 | A | | 8/1995 | Haas |
| 5,544,925 | A | | 8/1996 | Ikeda |
| 5,602,804 | A | | 2/1997 | Haas |
| 5,633,835 | A | | 5/1997 | Haas et al. |
| 5,667,303 | A | | 9/1997 | Arens et al. |
| 5,672,465 | A | | 9/1997 | Patel et al. |
| 5,699,326 | A | | 12/1997 | Haas et al. |
| 5,709,472 | A | | 1/1998 | Prusik et al. |
| 5,719,828 | A | * | 2/1998 | Haas et al. ..... 368/327 |
| 5,756,356 | A | | 5/1998 | Yanagi et al. |
| 5,785,354 | A | | 7/1998 | Haas |
| 5,797,344 | A | | 8/1998 | Ramsey et al. |
| 5,802,015 | A | | 9/1998 | Rothschild et al. |
| 5,822,280 | A | | 10/1998 | Haas |
| 5,830,683 | A | | 11/1998 | Hendricks et al. |
| 5,912,759 | A | | 6/1999 | Good et al. |
| 5,930,023 | A | | 7/1999 | Mitchell, Jr. et al. |
| 5,930,206 | A | | 7/1999 | Haas et al. |
| 5,947,369 | A | | 9/1999 | Frommer et al. |
| 5,959,295 | A | | 9/1999 | Braun |
| 5,989,852 | A | | 11/1999 | Hendricks et al. |
| 5,997,927 | A | | 12/1999 | Gics |
| 6,042,264 | A | | 3/2000 | Prusik et al. |
| 6,103,351 | A | | 8/2000 | Ram et al. |
| 6,113,857 | A | | 9/2000 | Manico et al. |
| 6,198,701 | B1 | | 3/2001 | De Jonghe et al. |
| 6,243,192 | B1 | | 6/2001 | Mitchell, Jr. et al. |
| 6,244,208 | B1 | | 6/2001 | Qiu et al. |
| 6,269,764 | B1 | | 8/2001 | Adamy et al. |
| 6,285,492 | B1 | | 9/2001 | Good et al. |
| 6,295,252 | B1 | | 9/2001 | Holt et al. |
| 6,331,076 | B1 | | 12/2001 | Coll |
| 6,373,786 | B1 | | 4/2002 | Kagan et al. |
| 6,426,503 | B1 | | 7/2002 | Wuest |
| 6,435,128 | B2 | | 8/2002 | Qiu et al. |
| 6,452,873 | B1 | | 9/2002 | Holt et al. |
| 6,544,925 | B1 | | 4/2003 | Prusik et al. |
| 6,750,458 | B1 | | 6/2004 | Rourk |
| 6,801,477 | B2 | | 10/2004 | Braunberger |
| 6,822,931 | B2 | | 11/2004 | Braunberger |
| 6,826,119 | B2 | | 11/2004 | Fortune |
| 7,079,452 | B2 | | 7/2006 | Harrison |
| 7,215,976 | B2 | | 5/2007 | Brideglall |
| 7,254,095 | B1 | | 8/2007 | Braunberger |
| 7,294,379 | B2 | | 11/2007 | Ko et al. |
| 7,362,663 | B2 | | 4/2008 | Kagan |
| 7,372,780 | B1 | | 5/2008 | Braunberger |
| 7,463,558 | B2 | | 12/2008 | Braunberger |
| 8,018,347 | B2 | | 9/2011 | Tehrani et al. |
| 2003/0053377 | A1 | | 3/2003 | Spevacek |
| 2003/0104353 | A1 | | 6/2003 | Brielmeier et al. |
| 2003/0104848 | A1 | | 6/2003 | Brideglall |
| 2003/0112711 | A1 | | 6/2003 | Braunberger |
| 2003/0151985 | A1 | | 8/2003 | Braunberger |
| 2003/0152483 | A1 | | 8/2003 | Munagavalasa et al. |
| 2004/0092023 | A1 | | 5/2004 | Wright |
| 2004/0232052 | A1 | | 11/2004 | Call et al. |
| 2005/0248455 | A1 | | 11/2005 | Pope et al. |
| 2005/0276165 | A1 | | 12/2005 | Chien |
| 2006/0145091 | A1 | | 7/2006 | Patel |
| 2006/0145863 | A1 | | 7/2006 | Martin et al. |
| 2006/0227669 | A1 | | 10/2006 | Pennaz et al. |
| 2007/0064541 | A1 | | 3/2007 | Kagan |
| 2007/0089433 | A1 | | 4/2007 | McDonell et al. |
| 2007/0268785 | A1 | | 11/2007 | Braunberger |
| 2008/0023362 | A1 | | 1/2008 | Genosar |
| 2008/0043804 | A1 | | 2/2008 | Goldsmith et al. |
| 2008/0210152 | A1 | | 9/2008 | Robinson et al. |
| 2009/0010304 | A1 | | 1/2009 | Skinner et al. |
| 2009/0016176 | A1 | | 1/2009 | Braunberger |
| 2009/0266291 | A1 | | 10/2009 | Braunberger |
| 2009/0303041 | A1 | | 12/2009 | Tehrani et al. |
| 2010/0149929 | A1 | | 6/2010 | Braunberger |
| 2010/0219351 | A1 | | 9/2010 | Roberts et al. |
| 2010/0251955 | A1 | | 10/2010 | Knoll |
| 2010/0275835 | A1 | | 11/2010 | Su et al. |
| 2011/0017123 | A1 | | 1/2011 | Maschietti et al. |
| 2011/0084128 | A1 | | 4/2011 | Haarer et al. |
| 2011/0286314 | A1 | | 11/2011 | Braunberger |

FOREIGN PATENT DOCUMENTS

| | | | |
|---|---|---|---|
| WO | 2004/077172 | A2 | 9/2004 |
| WO | 2009/038806 | A1 | 2/2009 |
| WO | 2010/099340 | A2 | 2/2010 |
| WO | 2011098830 | A1 | 8/2011 |

* cited by examiner

TIMING SYSTEM AND DEVICE AND METHOD FOR MAKING THE SAME

RELATED APPLICATION

This Patent Application claims priority under 35 U.S.C. 119(e) of the U.S. provisional patent application, Application No. 61/580,132, filed on Dec. 23, 2011, and entitled "TIMING SYSTEM AND DEVICE AND METHOD FOR MAKING THE SAME," which is also hereby incorporated by reference in its entirety.

FIELD OF THE INVENTION

The present invention relates to timing systems and visual indicators and devices and methods for making the same. More specifically, the invention relates to systems and devices for methods of indicating and/or recording; the passage of a duration of time.

BACKGROUND OF THE INVENTION

Galvanic cells, or Voltaic cells derive electrical energy from chemical reactions taking place within the cell. They generally consist of two different metals and an electrolyte. When the dissimilar metals come in contact with a common electrolyte, a potential difference is created between the metals. Once an electron path is provided, external to the cell itself, electrons flow from the anode to the cathode. Electrons flow from the anode to the cathode, depleting atoms of electrons, causing the remaining atoms to become ions.

These cells are more generally referred to within the public domain as batteries and are more predominantly used as a means of storing electrical energy.

However, some applications of these cells, like certain timing systems, temperature indicators and visual indicators, capitalize on other attributes inherent to these cells. One particular attribute of interest is the transformation of molecules within the anode from atom to ion and the subsequent change in optical properties. The optical properties of the anode change from opaque to transparent as atoms become ions.

The change in optical properties is relied upon within certain timing systems, temperature indicators and visual indicators, also referred to as time dependent color changing labels. Within these applications anode material consists of a thin metal film which has been deposited by evaporation or sputter or similar technique and configured on the same plane as a cathode such that when an electrolyte is introduced, anode atoms begin to deplete themselves of electrons and transform into ions, beginning at a point closest to the cathode. As depletion continues an ion rich transparent region begins to expand in a direction away from the cathode.

As the optical properties of the anode change from opaque to transparent backgrounds that used to lay hidden become visible. The expansion of the transparent region reveals various colors, text and/or patterns which have been printed just behind the anode. Progression of the transparent region indicates that increasing intervals of time have expired based on the appearance of colors text and/or patterns.

In some embodiments, timing devices are manufactured with an internal regulator configured for regulating the current flow of electrons within the timing device in order to control an expiration time period of the timing device. However, these timing devices are typically manufactured to expire at a set expiration time. Consequently, a consumer must choose a fixed time interval or duration before purchasing and using the device.

SUMMARY OF THE INVENTION

A timing device comprises an electrochemical timing structure and a mechanism that enables the timing device to be manually programmed to expire at a plurality of different time periods. In some embodiments, the mechanism is used to adjust the timing device to add a duration of time to an expiration time of the timing device. Alternatively the mechanism is used in order to subtract a duration of time from an expiration time of the timing device.

In one aspect, an adjustable timing device comprises an electrochemical timing structure and a mechanism manually adjustable in order to adjust an expiration time of the timing device. In some embodiments, the mechanism is external to the timing device. In some embodiments, the mechanism regulates a current flow within the timing device. In further embodiments, the mechanism is adjusted in order to increase the expiration time of the timing device. In still further embodiments, the mechanism is adjusted in order to decrease the expiration time of the timing device. In some embodiments, a portion of the timing device is removed in order to adjust the expiration time of the timing device. In further embodiments, the mechanism comprises a group of parallel resistors. In some embodiments, the electrochemical timing structure comprises an anode, a cathode, a base, an electrolyte, and a means of activating the timing device. In some embodiments, a visual change is seen as the timing device expires. In some embodiments, the timing device is coupled to an additional object. In some embodiments, the timing device further comprises a scale for indicating the time of expiration of the timing device.

In another aspect, a timing system comprises an anode layer, a cathode layer, an electrolyte, and a manually adjustable mechanism that regulates an electron current flow from the anode layer to the cathode layer. In some embodiments, the mechanism is external to the timing system. In some embodiments, adjusting the mechanism increases the rate of the flow of electrons from the anode layer to the cathode layer. In further embodiments, adjusting the mechanism decreases the rate of the flow of electrons from the anode layer to the cathode layer. In some embodiments, a portion of the timing system is removed in order to adjust the flow of electrons from the anode layer to the cathode layer. In further embodiments, the timing system comprises a group of parallel resistors. In some embodiments, a visual change is seen as the timing device expires. In further embodiments, the timing device is coupled to an additional object. In some embodiments, the timing system further comprises a scale for indicating the time of expiration of the timing device.

In a further aspect, a method of using an adjustable timing device comprises programming an expiration time of the timing device by changing an external characteristic of the timing device and activating the timing device. In some embodiments, programming the timing device comprises adding a duration of time to the expiration time of the timing device. In further embodiments, programming the timing device comprises subtracting a duration of time from the expiration time of the timing device.

DETAILED DESCRIPTION OF THE INVENTION

The description below concerns several embodiments of the presently claimed invention. The discussion references the illustrated preferred embodiment. However, the scope of the presently claimed invention is not limited to either the illustrated embodiment, nor is it limited to those discussed, to the contrary, the scope should be interpreted as broadly as possible based on the language of the Claims section of this document.

This disclosure provides several embodiments of the presently claimed invention. It is contemplated that any features from any embodiment can be combined with any features from any other embodiment. In this fashion, hybrid configurations of the illustrated embodiments are well within the scope of the presently claimed invention.

Figure 1:
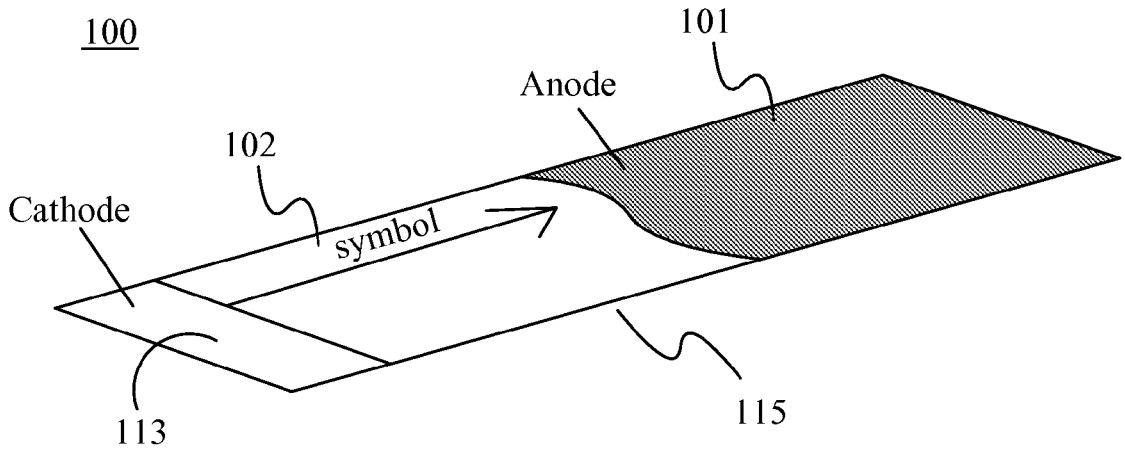
FIG. 1 illustrates a timing device in accordance with some embodiments.

Referring now to FIG. 1, a timing device is depicted therein. The timing device 100 comprises an anode 101 and a cathode 113 which have been deposited on a substrate 115, and a quantity of electrolyte (not shown). In some embodiments, the anode 101 and the cathode 113 are thin-film deposited onto the substrate 115. However, the anode 101 and the cathode 113 are able to be attached to the substrate 115 by any appropriate method as known in the art. Upon activation of the timing device 100, the anode 101 is depleted longitudinally away from and perpendicular to the cathode 113, as demonstrated by the arrow. The anode 101 is depleted as electrons travel from the anode 101 to the cathode. Depletion of the anode 101 occurs at a point nearest to the cathode 113 first and progresses longitudinally away from and perpendicular to the cathode 113. Depletion of the anode 101 occurs at an initial rate which lessens as the anode 101 depletes away from the cathode 113. In some embodiments, the timing device comprises multiple anode depletion patterns 102 printed or deposited onto the substrate 115 that are uncovered as the depletion of the anode 101 progresses. In some embodiments, as the anode 101 is depleted, a top layer becomes transparent. In some embodiment, the anode 101 comprises aluminum (Al) and the cathode 113 comprises copper (Cu).

The timing device 100 comprises a means to activate the device. In some embodiments, the timing device 100 comprises a protective reservoir which contains a small amount of electrolyte (not shown) molded to the cathode layer and protruding outward. The timing device is activated when a consumer applies pressure to the protrusion thereby braking the barrier and depositing the small quantity of electrolyte into contact with the dissimilar metals and activating the timing device.

In some embodiments, as the timing device expires a visual change is seen. For example, in some embodiments a color change or change in transparency is seen as the anode layer of the timing device is depleted.

Timing devices such as described above and that are electrochemically based rely on a electron flow through a path external to the cell itself. By influencing the flow of the electrons, the depletion rate and the amount of time which must transpire before the cell expires and a color change is seen may be influenced. One way to influence the flow of the electrons is by adjusting a total resistance to the flow of electrons within the timing device. Creating a larger resistance within the cell results in a slower rate of electron flow within the device and consequently a slower depletion rate of the anode layer and a longer time period before the timing device expires.

Figure 2:
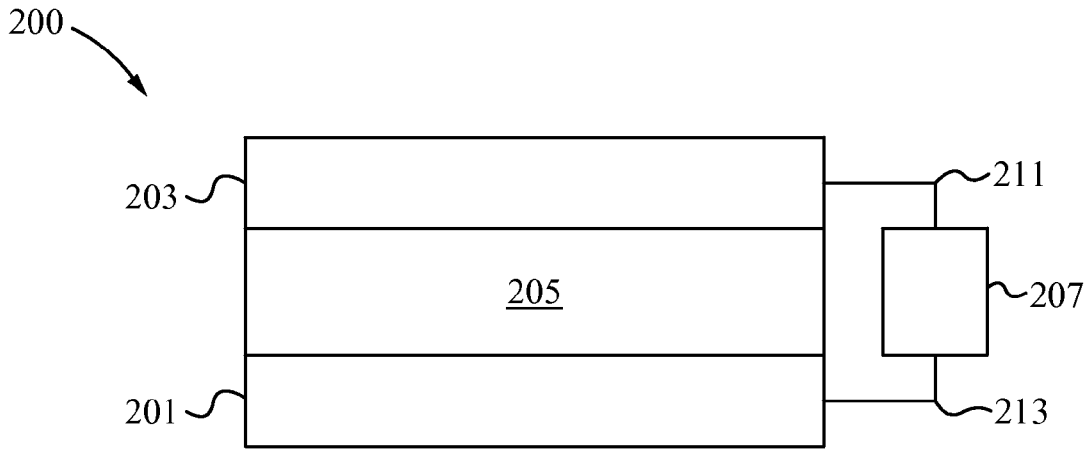
FIG. 2 illustrates a cross-section view of a reactive region of a timing device in accordance with some embodiments.

FIG. 2 illustrates a cross-section view of a reactive region 200 of a timing device with a mechanism for adjusting an expiration time period of the timing device in accordance with some embodiments. The reactive region 200 of the timing device reacts to produce a visual change and indicate a passage of time, as described above. In some embodiments, the timing device also includes a lens and a base.

The reactive region comprises an anode layer 203 a cathode layer 201 and an electrolyte 205 in order to create an electrochemical timing structure. As described above, when the anode layer 203 is placed in communication with the cathode layer 201 and the electrolyte 205, the anode layer 203 begins to deplete in order to indicate a passage of time. In some embodiments, the electrochemical timing device further includes the electrical connections 211 and 213 which enable a current to flow between the anode layer 203 and the cathode layer 201. As shown in FIG. 2, the reactive region 200 further includes an adjustment mechanism 207 for regulating the electron flow from the anode layer 203 to the cathode layer 201. In this manner, the mechanism 207 is able to control the rate at which the anode layer 203 is depleted and the expiration time of the timing device. In some embodiments, the mechanism is external to the reactive region 200 of the timing device and is adjustable. Particularly, by manipulating and/or adjusting the mechanism, 207 the rate at which electrons flow from the anode layer 203 to the cathode layer 201 the expiration of the anode layer 203 is able to be controlled and the timing device is able to be programmed to expire at a desired time period.

Figure 3A:
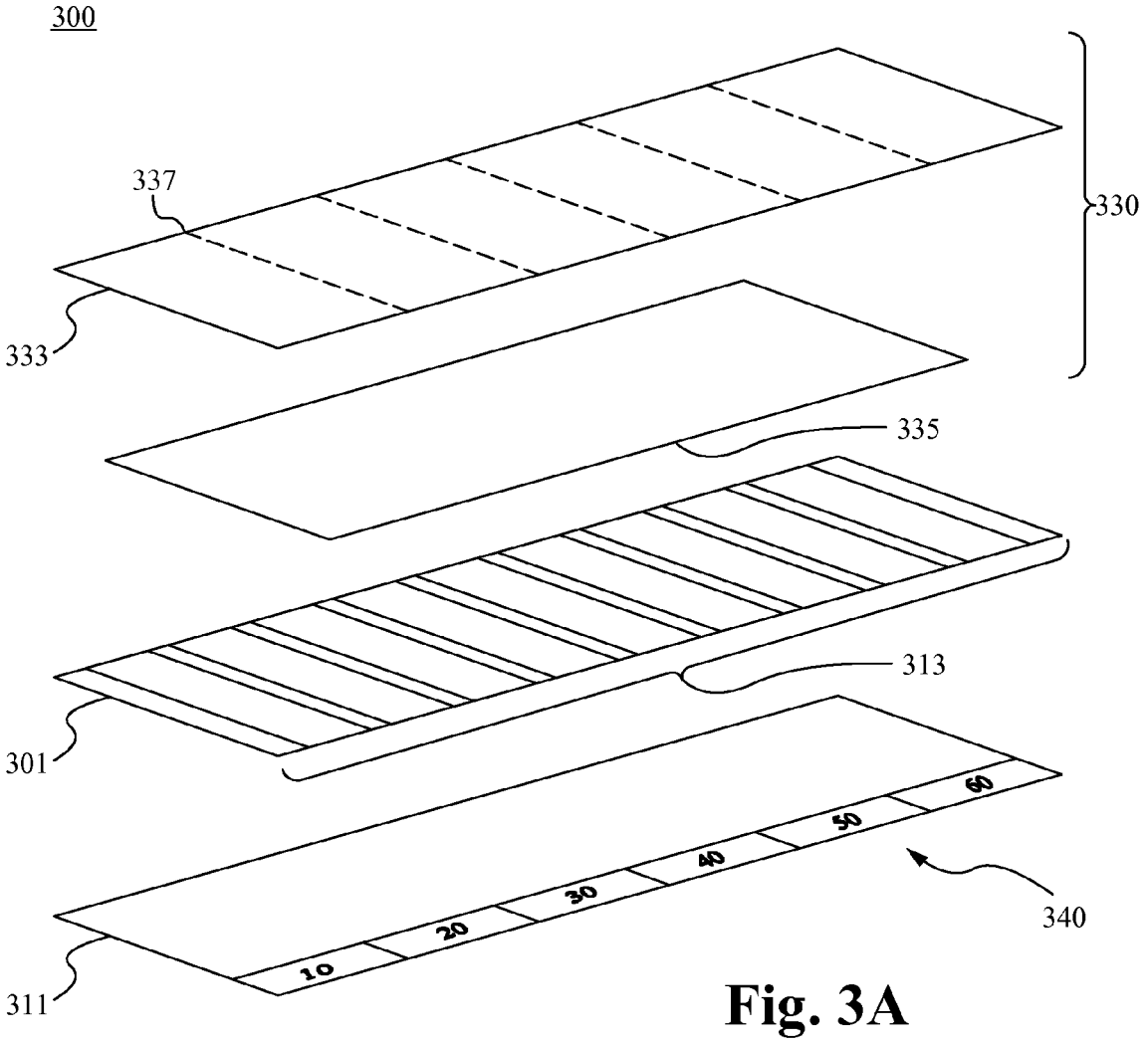
FIG. 3A illustrates an exploded view of a timing device and system in accordance with some embodiments.

FIG. 3A illustrates an exploded view of a timing device and system in accordance with some embodiments. The timing device 300 comprises a base 311, an anode layer 301, a quantity of electrolyte (not shown), and one or more cathode structures 313 introduced throughout the timing device 300. As described above, when the timing device 300 is activated, the anode layer 301 is depleted along the timing device 300. In some embodiments, as the anode layer 301 is depleted, a color change is seen and/or a symbol is uncovered. In some embodiments, the anode layer 301, the base 311, and the cathode structures 313 are attached by a platted through hole type method. However, as will be apparent to someone of ordinary skill in the art, the anode layer 301, the base 311, and the cathode structures 313 are able to be attached by any appropriate method. In some embodiments, the depletion of the anode layer 301 is able to be viewed through a lens of the timing device 300.

As further shown in FIG. 3A, the timing device 300 comprises an adjustment mechanism 330 for adjusting the flow of electrons from the anode layer 301 to the one or more cathode structures 313 and consequently adjusting an expiration rate and time of the timing device 300. As described above, by increasing or slowing the rate of the electron current flow from the anode layer 301 to the one or more cathode structures 313, the depletion rate of the timing device 300 is able to be increased or decreased, respectfully. In this manner, the adjustment mechanism 330 is used to program the timing device 300 to expire at a certain time.

The adjustment mechanism 330 comprises a first tape 335 and a second tape 333. In some embodiments, the first tape 335 comprises a metal tape with a high resistive value and the second tape 333 comprises a metal tape with a low resistive value. For example, in some embodiments, the first tape 335 comprises a carbon tape and the second tape 333 comprises a copper tape. In an assembled configuration, the second tape 333 completely covers the first tape 335. The second tape 333 and the first tape 335 interact in order create a total resistance ($R_T$) within the timing device 300 and at the first resistance, the timing device is configured to expire at a first expiration time. In some embodiments, as shown in FIG. 3A, the second tape 333 comprises one or more perforations 337. In these embodiments, one or more sections of the second tape 333 are able to be removed by lifting the second tape 333 and tearing it off at a perforation 337. When a section of the second tape 333 is removed, the total resistance of the timing device 300 is increased because more of the high resistivity first tape 335 is utilized. Thus, by changing the ratio of the high resistivity first tape 335 to the low resistivity second tape 333 the total resistance of the timing device 300 is changed and the timing device 300 is able to be programmed to expire at a certain time. Particularly, the expiration time of the timing device 300 is able to be adjusted to the desired expiration time by removing one or more sections of the second tape 333 and changing the total resistance and a rate of electron current flow within the timing device 300.

As described above, removing one or more sections of the second tape 333 increases the resistivity of the timing device 300 and increases the expiration time period of the timing device 300. However, as will be apparent to someone to ordinary skill in the art, the timing device 300 is able to be configured so that removing one or more sections of the second tape 333 decreases the total resistance of the timing device 300 and decreases the expiration time period of the timing device 300. Further, the timing device 300 is able to be configured so that adding one or more sections of the second tape 333 increases or decreases the total resistance of the timing device 300 and increases or decreases the expiration time period of the timing device 300, respectively. As shown in FIG. 3A, in some embodiments, the timing device 300 comprises a scale 340 in order to indicate how much time is being added or subtracted when using the adjustment mechanism 330 of the timing devise. In some embodiments, the timing device 300 is coupled to an additional object.

Figure 3B:
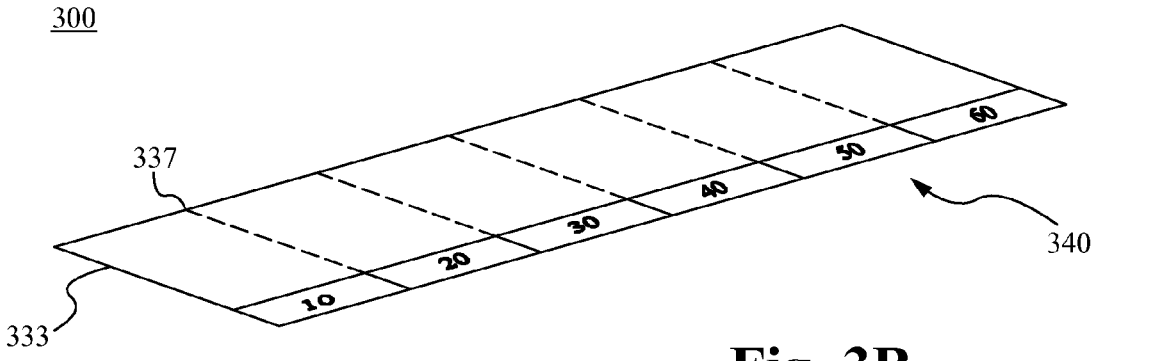
FIG. 3B illustrates a timing device and system in an assembled configuration in accordance with some embodiments.

FIG. 3B illustrates a timing device 300 in an assembled configuration in accordance with some embodiments. As described above, one or more sections of the tape 333 on a surface of the timing device 300 are removed in order to adjust and/or program the expiration time of the timing device 300. Particularly, the second tape 333 is able to be easily pulled back and torn at a perforation 337 in order to adjust the expiration time of the timing device 300 to a time as indicated by the scale 340.

Figure 4:
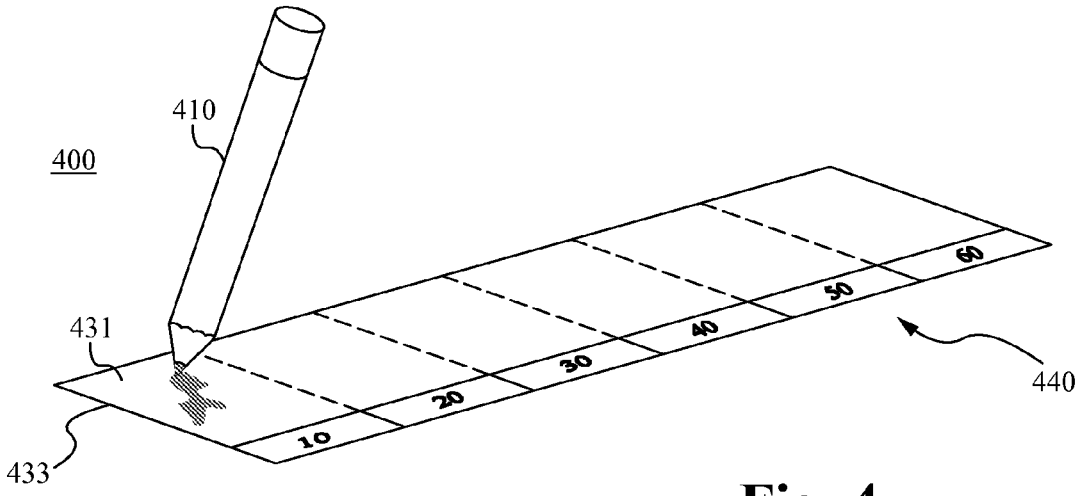
FIG. 4 illustrates a timing device and system in an assembled configuration in accordance with some embodiments.

FIG. 4 illustrates a timing device and system in an assembled configuration in accordance with some embodiments. The timing device 400 is similar to the timing device 300 as described above and comprises a base, an anode layer, a quantity of electrolyte, and one or more cathode structures introduced throughout the timing device 400. As described above, when the timing device 400 is activated, the anode layer is depleted along the timing device. In some embodiments, as the anode layer is depleted, a color change is seen and/or a symbol is uncovered. In further embodiments, the depletion of the anode layer is able to be viewed through a lens of the timing device 400.

As shown in FIG. 4, the second tape 433 comprises one or more adjustment sections 431. In these embodiments, the total resistance of the timing device 400 is adjusted by filling in one of the one or more adjustment sections 431 with a lead pencil 440. Since lead is a conductive metal, the total resistance of the timing device is changed when more or less lead is added to the second tape 433. Consequently, the one or more adjustment sections 431 are able to be filled in order to adjust the expiration time of the timing device 400 to a time as indicated by the scale 440. In some embodiments, the timing device 400 is coupled to an additional object.

Figure 5A:
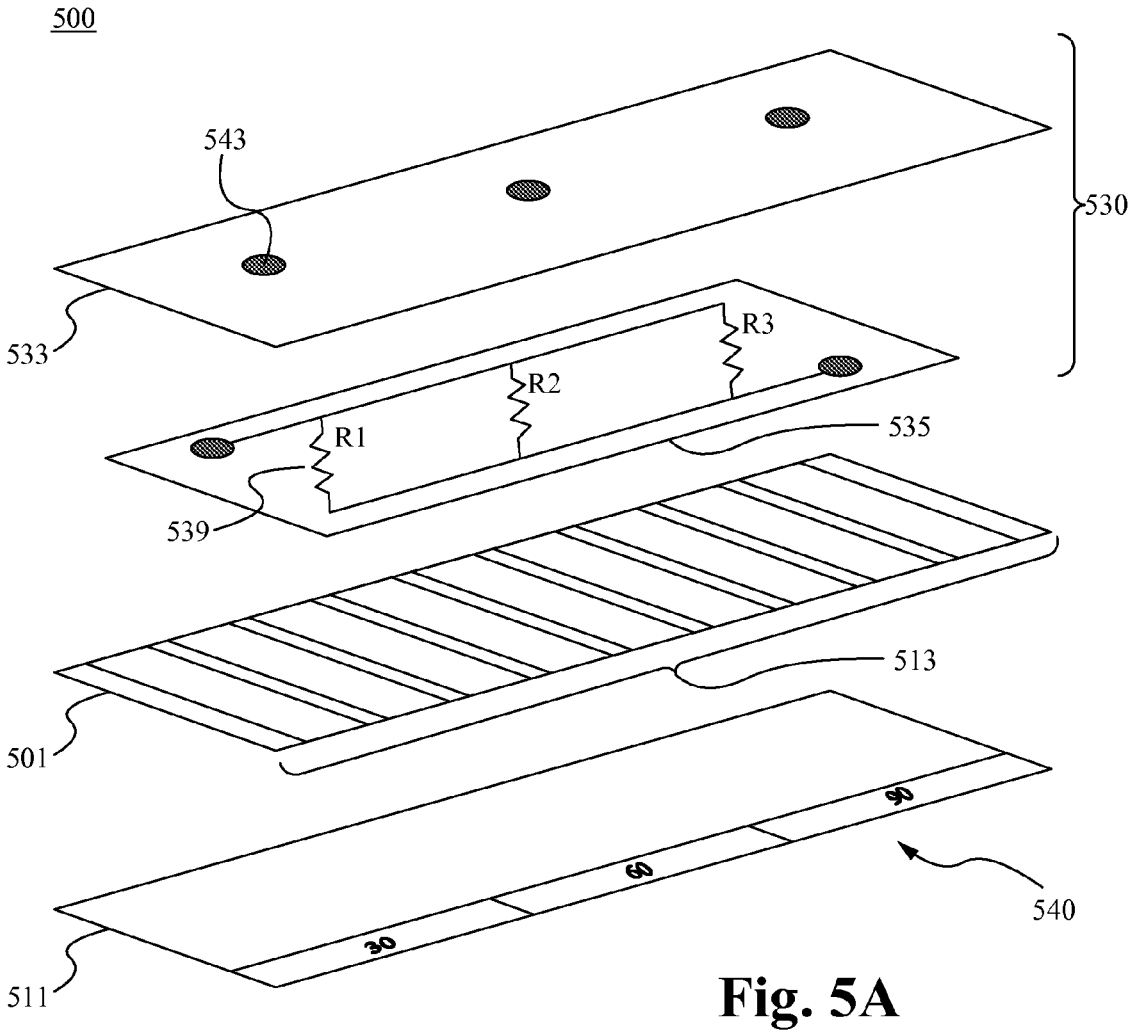
FIG. 5A illustrates an exploded view of a timing device and system in accordance with some embodiments.

FIG. 5A illustrates an exploded view of a timing device and system in accordance with some embodiments. The timing device 500 comprises a base 511, an anode layer 501, a quantity of electrolyte (not shown), and one or more cathode structures 513 introduced throughout the timing device 500. As described above, when the timing device 500 is activated, the anode layer 501 is depleted along the timing device 500. In some embodiments, as the anode layer 501 is depleted, a color change is seen and/or a symbol is uncovered. In some embodiments, the anode layer 501, the base 511, and the cathode structures 513 are attached by a platted through hole type method. However, as will be apparent to someone of ordinary skill in the art, the anode layer 501, the base 511, and the cathode structures 513 are able to be attached by any appropriate method. In some embodiments, the depletion of the anode layer 501 is able to be viewed through a lens of the timing device 500.

As further shown in FIG. 5A, the timing device 500 comprises an adjustment mechanism 530 for adjusting the flow of electrons from the anode layer 501 to the one or more cathode structures 513 and consequently adjusting an expiration rate and time of the timing device. As described above, by increasing or slowing the rate of the electron current flow from the anode layer 501 to the one or more cathode structures 513, the depletion rate of the timing device is able to be increased or decreased, respectfully. In this manner, the adjustment mechanism 530 is able to be used to program the timing device 500 to expire at a certain time.

The adjustment mechanism 530 comprises a cover 533 and a resistor sheet 535 with one or more parallel resistors 539. The cover also comprises one or more perforations or chads 543 which are configured to overlap and cover the one or more resistors when the timing device 500 is in an assembled configuration. The total resistance ($R_T$) of the timing device 500 is the product of the parallel resistors such that $R_T=(1/(1R_1)+1/(1R_2)+1/(1R_3)+\ldots 1/(1R_N))$. In an assembled configuration, when one of the one or more perforations or chads 543 is punched out, the corresponding parallel resistor 539 is severed. When a parallel resistor is severed, there is one less parallel resistor affecting the total resistance of the timing device and the total resistance is less. Consequently, the total resistance and expiration time of the timing device 500 is able to be adjusted to a desired expiration time period by punching out the appropriate number of chads 543 and changing the total resistance of the timing device 500. In some embodiments, the one or more chads 543 are punched out using a pencil, pen top, paper clip or other appropriately sized object. As further shown in FIG. 5A, the timing device further comprises a scale 540 in order to indicate how much time is being added or subtracted when using the adjustment mechanism 530 of the timing devise. In some embodiments, the timing device 500 is coupled to an additional object.

Figure 5B:
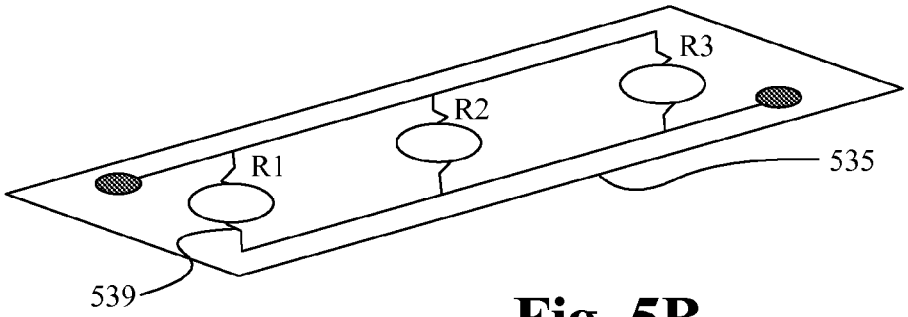
FIG. 5B illustrates a component of a timing device and system in accordance with some embodiments.

FIG. 5B illustrates the resistor sheet 535 as described above. As shown in FIG. 5B, when a chad 543 is punched out the path of the one or more resistors 539 is severed and/or punched out. Although FIGS. 5A and 5B show three parallel resistors 539, as will be apparent to someone of ordinary skill in the art, the timing device 500 is able to comprise any appropriate number of parallel resistors 539.

Figure 5C:
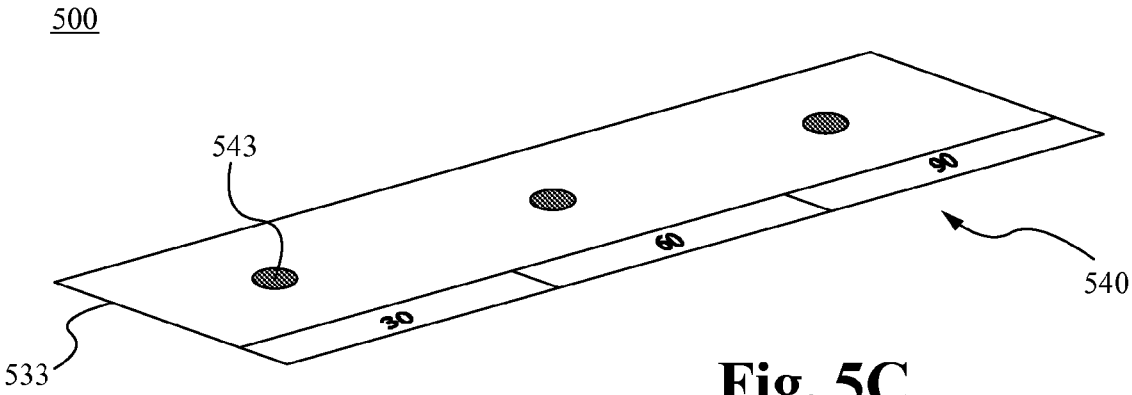
FIG. 5C illustrates a timing device and system in an assembled configuration in accordance with some embodiments.

FIG. 5C illustrates a timing device 500 in an assembled configuration in accordance with some embodiments. As described above, one or more of the chads 543 on a surface of the timing device 500 are punched out in order to adjust and/or program the expiration time of the timing device 500. Particularly, by punching out one or more of the chads 543 a parallel resistor is severed and the total resistance of the timing device is changed in order to adjust the expiration time of the timing device 500 to a time as indicated by the scale 540.

Figure 6:
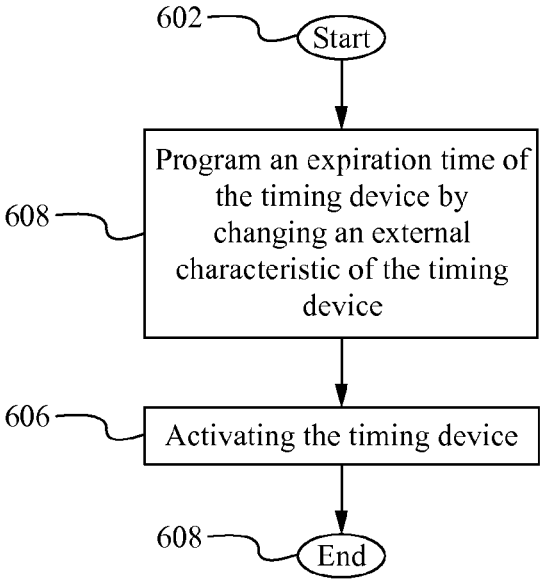
FIG. 6 illustrates a method of using an adjustable timing device in accordance with some embodiments.

FIG. 6 illustrates a method of using an adjustable timing device in accordance with some embodiments. As shown in FIG. 6, in the step 604, an expiration time of the timing device is programmed by changing an external characteristic of the timing device. In some embodiments, programming the timing device comprises adding a duration of time to the expiration time of the timing device. In some embodiments, programming the timing device comprises subtracting a duration of time from the expiration time of the timing device.

In use, a timing device and system is able to be programmed to expire at a variety of different time periods. By incorporating an external adjustment mechanism within a timing device, the timing device is able to be customized for a variety of different tasks. Particularly, this allows the user to decide how to precisely use the timing device without being stuck to a pre-determined time interval. In this manner, the time device is customizable for many different uses and tasks. Accordingly, the presently claimed invention as described herein has many advantages.

The present invention has been described in terms of specific embodiments incorporating details to facilitate the understanding of the principles of construction and operation of the invention. As such, references, herein, to specific embodiments and details thereof are not intended to limit the scope of the claims appended hereto. It will be apparent to those skilled in the art that modifications can be made in the embodiments chosen for illustration without departing from the spirit and scope of the invention.

I claim:

1. An adjustable timing device, comprising:

a. an electrochemical timing structure; and b. a mechanism that changes an external characteristic of the timing device and that is manually adjustable by one of adding a component to the timing structure or subtracting a component from the timing structure in order to adjust an expiration time of the timing device, wherein after activation, a depletion of the timing device is viewed through a lens.

2. The timing device of claim 1, wherein the mechanism is external to the timing device.

3. The timing device of claim 1, wherein the mechanism regulates a current flow within the timing device.

4. The timing device of claim 1, wherein the mechanism is adjusted in order to increase the expiration time of the timing device.

5. The timing device of claim 1, wherein the mechanism is adjusted in order to decrease the expiration time of the timing device.

6. The timing device of claim 1, wherein a portion of the timing device is removed in order to adjust the expiration time of the timing device.

7. The timing device of claim 1, wherein the mechanism comprises a group of parallel resistors.

8. The timing device of claim 1, wherein the electrochemical timing structure comprises:

a. an anode;

b. a cathode;

c. a base;

d. an electrolyte; and e. a means of activating the timing device.

9. The timing device of claim 1, wherein a visual change is seen as the timing device expires.

10. The timing device of claim 1, wherein the timing device is coupled to an additional object.

11. The timing device of claim 1, further comprising a scale for indicating the time of expiration of the timing device.

12. A timing system, comprising:

a. an anode layer;

b. a cathode layer;

c. an electrolyte; and d. a manually adjustable mechanism that changes an external characteristic of the timing system by one of adding a component to the timing system or subtracting a component from the timing system and that regulates an electron current flow from the anode layer to the cathode layer, wherein after activation, a depletion of the timing system is viewed through a lens.

13. The timing system of claim 12, wherein the mechanism is external to the timing system.

14. The timing system of claim 13, wherein adjusting the mechanism increases the rate of the flow of electrons from the anode layer to the cathode layer.

15. The timing system of claim 13, wherein adjusting the mechanism decreases the rate of the flow of electrons from the anode layer to the cathode layer.

16. The timing device of claim 13, wherein a portion of the timing system is removed in order to adjust the flow of electrons from the anode layer to the cathode layer.

17. The timing system of claim 12, wherein the timing system comprises a group of parallel resistors.

18. The timing system of claim 12, wherein a visual change is seen as the timing device expires.

19. The timing system of claim 12, wherein the timing device is coupled to an additional object.

20. The timing system of claim 12, further comprising a scale for indicating the time of expiration of the timing device.

21. A method of using an adjustable timing device, comprising:

a. programming an expiration time of the timing device by changing an external characteristic of the timing device by one of adding a component to the timing device or subtracting a component from the timing device; and b. activating the timing device, wherein after activation, a depletion of the timing device is viewed through a lens.

22. The method of claim 21, wherein programming the timing device comprises adding a duration of time to the expiration time of the timing device.

23. The method of claim 21, wherein programming the timing device comprises subtracting a duration of time from the expiration time of the timing device.

* * * * *